United States Patent [19]

Buettner

[11] 4,297,807

[45] Nov. 3, 1981

[54] TOY GAME BANK

[76] Inventor: Larry H. Buettner, 6146 Blackwall, Troy, Mich. 48098

[21] Appl. No.: 118,199

[22] Filed: Feb. 4, 1980

[51] Int. Cl.[3] ..... A63H 33/00; A63F 9/14

[52] U.S. Cl. ..... 46/4; 46/2; 273/397; 273/340

[58] Field of Search ..... 46/2, 3, 4, 5, 43; 273/355, 378, 381, 382, 394, 397, 402, 353, 341, 342, 424, 317, 86 D, 340; 133/8 A, 3 C, 3 D, 3 E

[56] References Cited

U.S. PATENT DOCUMENTS

| | | | |
|---|---|---|---|
| 166,978 | 8/1875 | Feigl | 46/2 |
| 517,071 | 3/1894 | Russell | 46/2 |
| 574,528 | 1/1897 | Elder | 133/3 C |
| 1,442,054 | 1/1923 | Dixon | 273/397 |
| 1,521,532 | 12/1924 | Hansen | 46/4 |
| 1,582,796 | 4/1926 | Smith | 273/86 D |
| 2,594,448 | 4/1952 | Kieselhorst | 46/4 |
| 4,186,926 | 2/1980 | Kulesza et al. | 273/340 |

*Primary Examiner*—Paul J. Hirsch
*Assistant Examiner*—Michael J. Foycik
*Attorney, Agent, or Firm*—Robert G. Mentag

[57] ABSTRACT

A toy game bank which may be used an an amusement and educational apparatus for children, and a conversation piece for adults. The toy game bank includes a supporting base member which contains an interior chamber for coins, a vertical wall member which is mounted on the rear end of the supporting base member, a coin track member which is mounted on the top end of the wall member, and a funnel which is mounted on one end of the coin track member. A coin track system is formed from the bottom of the funnel and it extends through the coin track member and down across the front face of the wall member, and through a coin track block member on the supporting base member, and into the interior chamber of the supporting base member. A lever and hammer is mounted on one side of the supporting base member for propelling coins upwardly through a flight path so that they will land in the funnel and then roll through the coin track system down to the interior chamber in the supporting base member. An indicator such as a bell or other structure, may be provided in the funnel for playing games.

6 Claims, 7 Drawing Figures

TOY GAME BANK

BACKGROUND OF THE INVENTION

1. Field of the Invention

This invention relates to the coin toy bank art, and more particularly to a novel and improved coin toy game bank art. The invention is specifically concerned with a coin toy game bank which includes a mechanical means for propelling a coin into a funnel means from where it is conveyed through a coin track system into an interior chamber in a supporting base member.

2. Description of the Prior Art

It is well known in the coin bank art to employ mechanical means for throwing a coin in a predetermined direction and to provide means for receiving the thrown coin. A disadvantage of such prior art coin banks is that they are complex and expensive to make, and in some cases difficult to operate. Examples of such prior art coin banks are illustrated in U.S. Pat. Nos. 385,225; 1,521,532; 2,448,951; 2,861,387 and 4,050,183. Further examples of coin toy banks including coin guide ways are illustrated in U.S. Pat. Nos. 626,528; 1,066,076; 2,749,656; 3,002,313 and 3,313,477.

SUMMARY OF THE INVENTION

In accordance with the present invention, the coin toy game bank of the present invention includes a supporting base member which is provided with an interior chamber for the reception of coins. A vertical wall member is mounted on the supporting base member, at the rear end thereof. A vertical coin track system is operatively formed on the vertical wall member and the supporting base member through which a coin will roll by gravity. The vertical coin track system has an upper end and a lower end terminating adjacent an opening, in the supporting base member, which communicates with the supporting base member interior chamber. A funnel means is carried by the vertical wall member in a position above the supporting base member, and it communicates at the lower end thereof with the upper end of the vertical coin track system. A mechanical coin propelling means is mounted on the supporting base member for propelling a coin upwardly into said funnel means for passage therefrom into said coin track system and thence into the supporting base member interior chamber.

The coin toy bank of the present invention has educational values. It is ideal for children, and it is a novel conversation piece for adults. It provides fun and amusement in operating the same, as well as providing fun for those watching the operation of the bank. The mechanical coin propelling means comprises a hammer or mallet which is allowed to fall on one end of a lever whereby the lever is flipped and a coin carried on the lever is propelled upwardly and into the funnel means. The funnel means has a conically shaped interior chamber which communicates at its lower end with the vertical coin track system, and the upper end thereof is formed so as to provide a downwardly and forwardly sloping open face for optimum reception of a propelled coin. An indicator means, such as a bell or the like, may be mounted in the interior chamber of the funnel, and games played, whereby if the coin hits the bell, so many points may be given, as compared to a lower number of points given when the coin merely enters the funnel and does not hit the indicator means. The funnel means may also be converted to other type configurations as, for example, a pair of tubular reception members may be included on the upper end of the funnel body, with one of the tubular members being centrally disposed and communicating with the interior chamber of the funnel, and the other tubular member being concentrically mounted around the first central tubular member and adapted only to catch coins and not permit them to run down into the vertical coin track system. In playing a game with the last mentioned structure, a person could obtain a greater number of points by propelling the coin into the central tubular member to allow the coin to pass into the vertical coin track system, as compared to a lesser number of points when the coin is propelled into the outer tubular member which surrounds the inner tubular member, but which is not connected to the vertical coin track system.

Other objects, features and advantages of this invention will become apparent from the following detailed description, appended claims, and the accompanying drawings.

DESCRIPTION OF THE PREFERRED EMBODIMENTS

Figure 1:
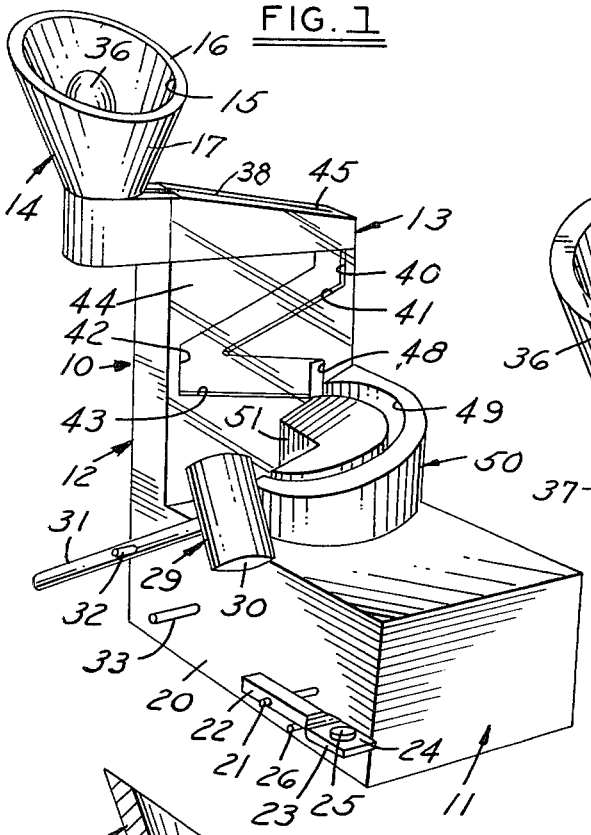
FIG. 1 is an elevational perspective view of a toy game bank made in accordance with the principles of the present invention.
Figure 2:
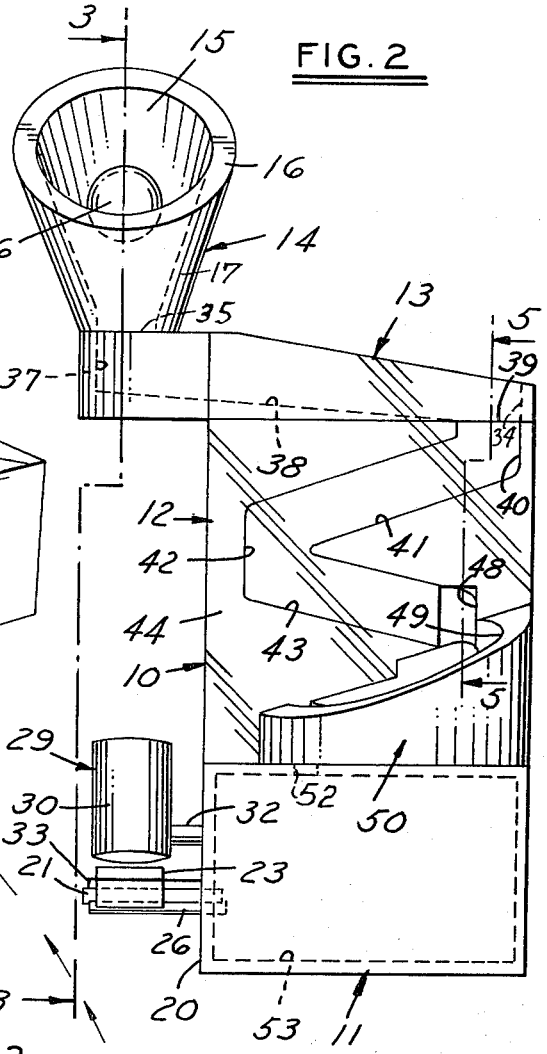
FIG. 2 is a front elevational view of the toy game bank illustrated in FIG. 1.
Figure 3:
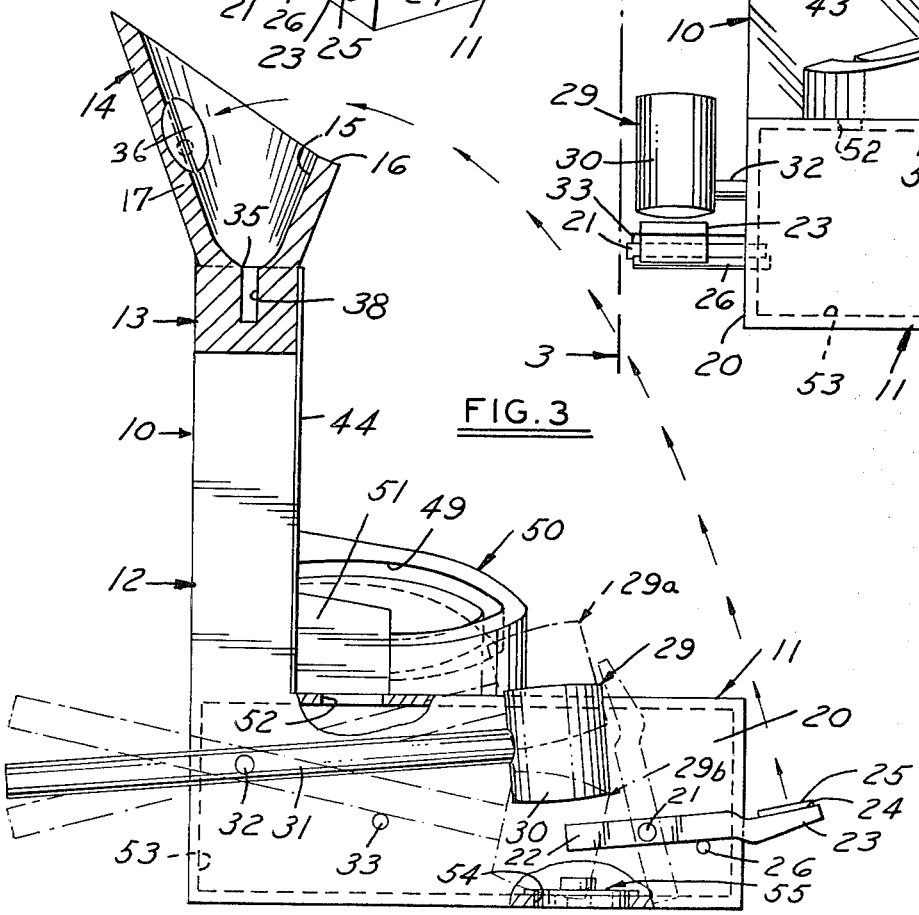
FIG. 3 is a left side elevation view, partly in section, of the toy game bank illustrated in FIG. 2, taken along the line 3—3 thereof, and looking in the direction of the arrows.

Referring now to the drawings, and particularly to FIGS. 1 through 4, the numeral 10 generally designates a toy game bank made in accordance with the principles of the present invention, and illustrating a first embodiment of the invention. The numeral 11 generally designates a substantially rectangular supporting base member. The numeral 12 generally designates a substantially rectangular, vertical wall member which has its lower end integrally formed with the rear end of the supporting base member 11. As best seen in FIGS. 1, 2 and 3, a coin track member, generally designated by the numeral 13, is fixedly mounted on the top end of the vertical member 12 by any suitable means. At best seen in FIGS. 1 and 2, the left end of the coin track member 12 is extended outwardly from the left side of the vertical support wall member 12 and has fixedly mounted on the top side thereof, by any suitable means, a funnel generally indicated by the numeral 14. The supporting base member 11, vertical wall member 12, coin track member 13, and funnel member 14 can all be made from any suitable material, as for example, wood. If the material employed for the last mentioned members is wood, then the coin track member 13 may be adhered to the vertical wall member 12 by a suitable adhesive, and the funnel member 14 may also be adhered to the coin track member 13, by a suitable adhesive.

As shown in FIGS. 1 through 4, the funnel 14 has an inverted, conically shaped body 17 which is open at the upper end thereof, and which has an interior chamber 15 with a downwardly converging conical wall surface. The upper open end of the funnel 14 is provided with a forwardly sloping surface 16 that slopes from a high rear point downwardly and forwardly.

As best seen in FIG. 1, a coin tossing or coin throwing lever 22 is pivotally mounted on the left side 20 of the supporting base member 11 by a suitable shaft member 21. The shaft 21 is fixedly mounted in a suitable aperture in the left side wall 20 of the supporting base member 11. The lever 22 has integrally attached at the front end thereof a coin platform 23 which has a coin seating surface 24, on which is adapted to be mounted a coin indicated by the numeral 25. The coin 25 would be of a value suitable in size to pass through the hereinafter described coin tract system, such as a penny, a nickel, a dime or a quarter.

As best seen in FIGS. 1 and 3, the lever 22 is normally held by gravity in an initial position by a support shaft 26 which has its inner end fixedly mounted in a suitable aperture in the supporting base member side wall 20. It will be seen that gravity pivots the lever 22 clockwise, as viewed in FIG. 3, so that the underside of the lever 22 seats on the shaft 26 for normally holding the lever 22 in the initial position.

As shown in FIGS. 1 through 4, a hammer or mallet, generally indicated by the numeral 29, is pivotally mounted on the left side of the supporting base member 11. The mallet 29 includes the cylindrical head member 30 to which is operatively secured an elongated handle 31. The handle 31 is pivotally mounted on a suitable pivot shaft 32 which has its inner end fixedly mounted in a suitable aperture in the left side wall 20 of the supporting base member 11, and it is fixedly mounted in a suitable aperture in the left side wall 20 of the supporting member 11. It will be seen that the stop pin 33 limits the downward clockwise pivotal movement of the hammer or mallet 29.

Figure 4:
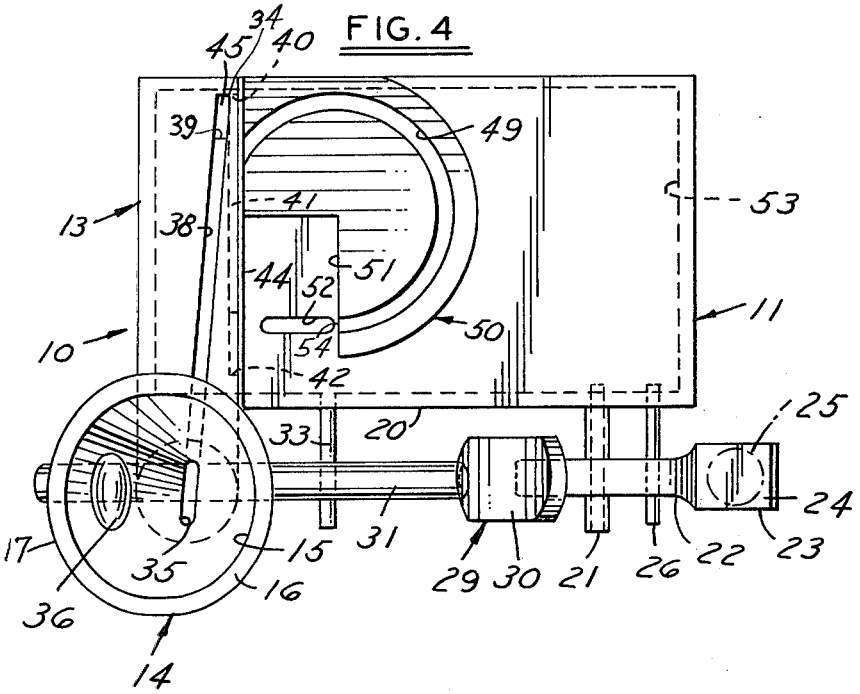
FIG. 4 is a top plan view of the toy game bank illustrated in FIGS. 1 through 3.

As shown in FIGS. 3 and 4, the lower end of the conically converging surface of the interior chamber 15 of the funnel 14 terminates at a discharge opening 35 which communicates with a slot or coin track 38 that is formed longitudinally in the coin track member 13. A bell 36 is operatively mounted on the rear side of the surface of the interior chamber 15. The slot 38 is open along the upper end thereof. As shown in FIG. 2, the forward end of the slot 38 is indicated by the numeral 37, and the slot 38 slopes downwardly from the forward end 37 to the right, as viewed in FIG. 2. The numeral 34 in FIG. 4 designates the rear or discharge end of the slot 38, and adjacent thereto is a downward opening discharge port 39.

Figure 5:
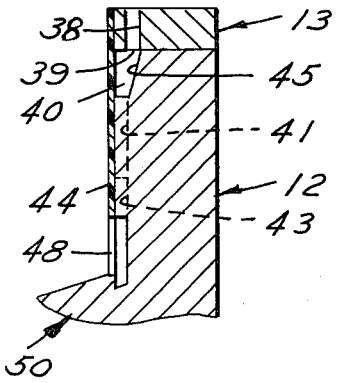
FIG. 5 is a fragmentary, elevation section view of the toy game bank illustrated in FIG. 2, taken along the line 5—5 therof, and looking in the direction of the arrows.

The discharge port 39 communicates with one end of a coin track that is formed, in the front face of the vertical wall member 12, in the form of a "V" disposed on its side. It will understood that other shapes may be employed for this coin track. As shown in FIGS. 1 and 2, the last mentioned coin track comprises a vertical portion 40 which has an enlarged upper end that has a taper 45 on the inner wall (FIG. 5) which communicates with the discharge port 39. As shown in FIGS. 1 and 2, the coin track vertical portion 40 communicates with a straight coin track portion 41 which slopes downwardly and to the left side of the bank. The coin track portion 41 terminates in a U-shaped or bight portion 42 which in turn communicates with a lower coin track portion 43 that slopes downwardly and to the right of the bank. The front face of the vertical wall member 12 has a transparent cover 44 mounted thereover, such as transparent plastic or glass which covers the last mentioned coin tracks 40 through 43. The transparent cover member 44 may be fixed to the vertical wall member 12 by any suitable means, as by screws or an adhesive. As shown in FIG. 1, the lower right end of the coin track portion 43 terminates at a discharge opening 48 which is formed through the transparend cover member 44.

As shown in FIGS. 1 through 4, a coin track block, generally indicated by the numeral 50, is fixedly mounted on the top side of the supporting base member 11, with its inner face having a flat surface disposed adjacent the transparent cover member 44. The exterior outer surface of the block 50 forms a continuous curve. The surface of the block 50 slopes downwardly from the right side of the bank toward the left side of the supporting base member 11. A part-circular coin track 49 is formed in the upper end of the coin track block 50. The leading or entrance end of the coin track 49 is disposed adjacent the discharge opening 48 in the transparent cover member 44. The coin track block 50 may be made from any suitable material, as wood, plastic, metal and the like, and it may be suitably adhered to the supporting base member 11.

As best seen in FIG. 4, the coin track block 50 has a rectangular cutout indicated by the numeral 51 between the outer face of the transparent cover 44 and the discharge end 54 of the slot or coin track 49.

As shown in FIGS. 3 and 4, an elongated slot 52 is formed through the top wall of the supporting base member 11, and it is aligned with the discharge end of the coin track 49 for the reception of coins discharged therefrom. The elongated slot 52 permits the coins leaving the coin track 49 to drop into the interior chamber 53 in the supporting base member 11. Access to the interior chamber 53 to remove coins therefrom is permitted through a circular opening 54 (FIG. 3) formed through the bottom wall of the supporting base member 11. The opening 54 is adapted to be normally closed by a suitable, releasable enclosure member, generally indicated by the numeral 55, which may be of any suitable type, as for example the closure member normally used on conventional coin banks.

In use, the toy bank 10 illustrated in FIGS. 1 through 5 is operated by gripping the rear end of the hammer handle 31 and pivoting the hammer upwardly so that the hammer 29 is in the dotted line position indicated by the numeral **29*a*. A coin 25 is then placed on the coin seating surface 24 of the lever 22. The handle of the hammer 29 is then released, whereby the hammer 29 will pivot downwardly by gravity, in a clockwise direction, as viewed in FIG. 3, to a position indicated by the numeral 29*b* where it will be stopped by the stop pin 33. The downward swinging movement of the hammer 29 will cause the hammer head 30 to hit the rear end of the lever 22 and rotate it counter-clockwise, as viewed in FIG. 3, to the broken line position indicated by the numeral 22*a*. The upward swinging of the lever 22 will toss or propel the coin 25 upwardly through an arcuate path shown by the arrows in FIG. 3 and into the interior chamber 15 of the funnel 14. If the coin 25 follows the flight path shown in FIG. 3, it would hit the bell 36 and ring the same. It will be understood that any suitable indicator means could be employed, as for example, an electrical indicator means operated by contact with a coin 25 instead of the bell-type indicator 36, which is actuated by the physical hitting of the same by the coin 25**.

It will be seen that the present invention provides a mechanical means of depositing a coin in a bank, because after the coin 25 lands in the funnel 14 it slides down by gravity through the opening 35 and into the coin track 38. As viewed in FIG. 1, the coin 25 then rolls to the right end of the coin track 38, at which point it falls down through the port or opening 39 and slot 40 and into the coin track 41. The coin 25 then rolls to the left and through the U-shaped coin track portion 42 and then to the right and downwardly through the coin track 43. The coin 25 then emerges from the track 43 through the opening 48 from where it enters the circular coin track 49 and rolls therethrough and out into the cutout space 51 of the block 50. The coin 25 then drops downwardly by gravity through the slot 52 into the interior chamber 53 in the supporting base member 11.

It will be seen that the toy bank 10 of the present invention provides fun and and amusement for children, and other users. The operation of the toy bank 10 of the present invention is interesting and fun to watch, and it is ideal for children and a conversation piece for adults.

It will be seen that the flight path of a coin 25 up to the funnel 14 will be determined by the strength of the blow imparted to the rear end of the lever 22. Accordingly, it will be seen that a game could be devised whereby a certain number of points could be given if the coin 25 hit the bell 36, as compared to a lesser number of points if the coin 25 were to enter the funnel 14 without hitting the bell 36. Also, zero points could be given in instances wherein the lever 22 is not hit hard enough to throw a coin 25 up to the funnel 14, or the lever 22 was hit so hard that the coin 25 flew over the funnel 14. It will be understood that the various slots and coin tracks may be made to any size so as to accommodate coins from pennies to silver dollars.

Figure 7:
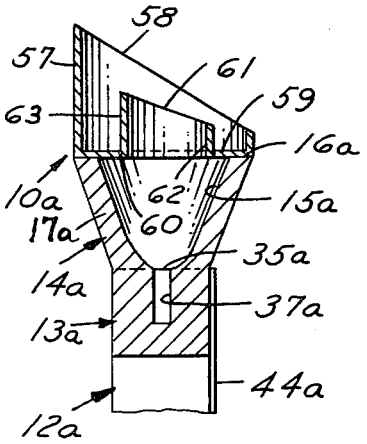
FIG. 7 is a fragmentary elevational section view of the modified embodiment illustrated in FIG. 6, taken along the line 7—7 thereof, and looking in the direction of the arrows.
Figure 6:
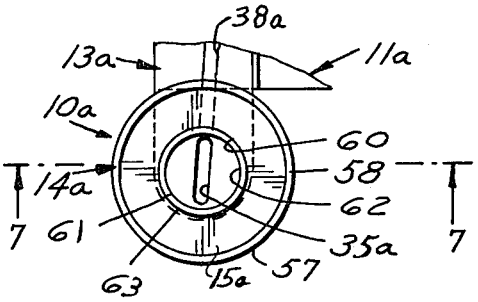
FIG. 6 is a fragmentary, top plan view of a modified embodiment of the toy game bank of the present invention.

FIGS. 6 and 7 illustrate a modified embodiment of the invention, and the parts of the embodiment of FIGS. 6 and 7 which are the same as the first embodiment of FIGS. 1 through 5 have been marked with the same reference numerals, followed by the small letter "*a*". In the embodiment of FIGS. 6 and 7, the upper surface **16*a* of the funnel 14*a* is made level, and a cylindrical funnel extension structure is fixedly mounted on the flat upper surface 16*a* of the funnel 14*a*. The funnel extension structure includes an outer tubular member 57 which has a forwardly sloping peripheral upper end surface 58. The lower end of the tubular member 57 is enclosed by a bottom wall 59, which is fixedly seated on the flat upper surface 16*a* of the funnel 14*a*, and through which is centrally formed a tubular opening 60. A smaller diameter tubular member 63 has its lower end fixedly mounted in the opening 60. The upper end of the smaller diameter tubular member 63 slopes forwardly and downwardly as indicated by the numeral 61. The passage or bore 62 through the tubular member 63 communicates at its lower end with the funnel interior 15*a* and the coin slot 35*a* which in turn communicates with a transverse coin track 38*a*** in the same manner as in the first embodiment.

In use, the modified embodiment of FIGS. 6 and 7 would operate in the same manner as the first embodiment of FIGS. 1 through 5, in that a coin 25 would be propelled upwardly toward the funnel **14*a* in the same manner as described hereinbefore for said first embodiment. However, when a coin 25 enters the funnel extension structure illustrated in FIGS. 6 and 7, the coin 25 will either go into the central tubular member 63 and thence pass downwardly through the aforedescribed coin track system and into the bank interior chamber 53, or it will land in the larger member 57 and not pass through the coin track system. Accordingly, a game may be devised whereby a certain number of points would be given for instances when a coin 25 passed through the smaller tubular member 63 and through the coin track system of the bank, and a lesser number of points when a coin 25 entered the larger tubular member 57 and was trapped therein. Also, zero points may be given for coins 25 which are propelled over the funnel 14*a* or which do not reach the funnel 14*a***.

While it will be apparent that the preferred embodiments of the invention herein disclosed are well calculated to fulfill the objects above stated, it will be appreciated that the invention is susceptible to modification, variation and change.

What is claimed is:

1. A coin toy game comprising:

(a) a supporting base member having a coin receiving interior chamber;

(b) a vertical wall member mounted on the supporting base member;

(c) means on said vertical member and supporting base member which forms a vertical coin track system, including a zig-zag coin path portion, through which a coin will roll by gravity and which has an upper end and a lower end terminating adjacent an opening in the supporting base member which communicates with the supporting base member interior chamber;

(d) a funnel means carried by said vertical wall member in a position above the supporting base member and communicating at the lower end thereof with the upper end of said coin track system;

(e) mechanical coin propelling means mounted on said supporting base member for propelling a coin upwardly into said funnel means for passage therefrom into said coin track system and thence into the supporting base member interior chamber;

(f) said mechanical coin propelling means is a manually operated propelling means;

(g) said mechanical coin propelling means including (1) a lever pivotally mounted on the supporting base member and having a coin receiving surface for disposing a coin thereon; and, (2) means operatively mounted on said supporting base member for pivoting said lever, whereby a coin disposed thereon will be propelled upwardly into said funnel means; and, (h) said means for pivoting said lever comprising a mallet having a handle pivotally mounted on the supporting base member and a mallet head on the handle for striking one end of said lever, whereby when the handle is manually pivoted downwardly, the mallet is raised upwardly to a position above said lever, and when the handle is released the mallet falls by gravity downwardly and strikes the lever.

2. A coin toy game bank as defined in claim 1, wherein said funnel means includes:

(a) a funnel body with a conically shaped interior chamber which is open at the upper end thereof; and, (b) an indicator means operatively mounted in the interior chamber of the funnel.

3. A coin toy game bank as defined in claim 2, wherein:

(a) said indicator means comprises a sound indicator means.

4. A coin toy game bank as defined in claim 3, wherein:

(a) said sound indicator means comprises a bell means.

5. A coin toy game bank as defined in claim 1, wherein said funnel means includes:

(a) a funnel body with a conically shaped interior chamber which is open at the upper end thereof; and, (b) a pair of concentrically disposed tubular members mounted on said funnel body, with one of the tubular members communicating with the interior chamber in said funnel body.

6. A coin toy game bank as defined in claim 1, wherein said means which forms a vertical coin track system includes:

(a) a coin track member mounted on the vertical wall member and having said funnel means mounted on one end thereof, and having a coin track formed therethrough with one end thereof communicating with the lower end of the funnel means;

(b) a coin track formed in one face of the vertical wall member and having an upper end and a lower end, and communicating at its upper end with the other end of the coin track in the coin track member; and, (c) a coin track block mounted on the supporting base member and having a coin track formed therethrough which has one end communicating with the lower end of the coin track in the face of the vertical wall member, and the other end terminating adjacent said opening in the supporting base member which communicates with the supporting base member interior chamber.

* * * * *